US006896027B2

(12) United States Patent
Crouch

(10) Patent No.: US 6,896,027 B2
(45) Date of Patent: May 24, 2005

(54) METHOD AND APPARATUS FOR SUSPENDING A DOOR

(75) Inventor: Josh S. Crouch, Douglasville, GA (US)

(73) Assignee: NCI Building Systems, L.P., Houston, TX (US)

( * ) Notice: Subject to any disclaimer, the term of this patent is extended or adjusted under 35 U.S.C. 154(b) by 0 days.

(21) Appl. No.: 10/619,744

(22) Filed: Jul. 15, 2003

(65) Prior Publication Data

US 2005/0011620 A1 Jan. 20, 2005

(51) Int. Cl.[7] ..... E05F 11/00
(52) U.S. Cl. ..... 160/315; 160/191
(58) Field of Search ..... 160/315, 191, 160/192, 133, 201; 16/197, 198, DIG. 1, 16/DIG. 7

(56) References Cited

U.S. PATENT DOCUMENTS 4,930,182 A * 6/1990 Eichenberger ..... 16/198
4,981,165 A * 1/1991 Miller et al. ..... 160/191
5,778,490 A * 7/1998 Curtis ..... 16/198
5,865,235 A * 2/1999 Krupke et al. ..... 160/191
6,134,835 A * 10/2000 Krupke et al. ..... 49/200
6,155,327 A * 12/2000 Wells et al. ..... 160/310
6,263,541 B1 * 7/2001 Scates ..... 16/198
6,283,193 B1 * 9/2001 Finch et al. ..... 160/191
6,527,037 B2 * 3/2003 Daus et al. ..... 160/315
6,644,378 B2 * 11/2003 Mitchell ..... 160/191

* cited by examiner

*Primary Examiner*—David Purol
(74) *Attorney, Agent, or Firm*—Gardere Wynne Sewell LLP

(57) ABSTRACT

A spring tensioning mechanism incorporating a frame having a substantially-planar main panel and a bore passing therethrough, and an axle disposed orthogonally to the substantially-planar main panel and passing through the bore. A spring is disposed around the axle. An outboard plate, disposed about the axle, is secured to the frame. The outboard plate incorporates a clocking feature. An inboard plate, having a clocking feature mated to the clocking feature of the outboard plate, is connected to the end of the spring.

26 Claims, 5 Drawing Sheets

METHOD AND APPARATUS FOR SUSPENDING A DOOR

FIELD OF THE INVENTION

The present invention relates generally to tensioning devices and more specifically to an apparatus for tensioning devices for live axle doors.

BACKGROUND OF THE INVENTION

A live axle roll up door is a door made of a flexible material, or having hinged segments, that raises and lowers by means of a rotating axle located above the door frame. The door is typically attached at an end to a set of drum wheels that rotate with the axle. As the axle rotates, the door rolls up onto the drum wheels. If the direction of rotation of the axle is reversed, the door rolls off of the drum wheel and travels downward to close. In warehouses and mini-storage facilities it is common to place a live axle roll up door at the opening to the building. These doors are usually relatively lightweight and designed to be easily and quickly retracted either manually or automatically.

In order to allow for manual operation of the door, a coil spring is usually installed at the top of the door to counterbalance the weight of the door. The coil spring is usually disposed around a shaft and fixed to the shaft at one end, such that the spring rotates with the shaft, and fixed to a stationary structure at the other end. The torsional forces created in the spring by the rotation of the shaft provide a variable torque which counteracts the weight of the door. As the door is lowered, the torsional forces developed in the spring pull in the opposite direction of the travel of the door. The amount of tension resulting from the torsional forces generated in the coil spring will determine the performance characteristics of the door.

If there is too little tension, the weight of the door may cause the door to drift down from the open position to the closed position. If the tension is too great, the door may be hard to pull down and it may not stay closed. Also, a door with too much tension in the spring will fly up upon exertion of an upward force to open the door. If the amount of tension is set correctly, the door can be lowered gently and a balance will be struck between the weight of the door and the force exerted by the spring. At certain positions, the weight of the door may balance with the force of the spring and the door can be left partially open. In the closed position, the weight of the door will overcome the force of the spring and the end of the door will rest on the ground. Also, if the door is adjusted properly, a small amount of upward force will release the potential energy of the spring and the door will easily travel in the vertical direction.

The live axle is free to rotate within and is supported by brackets on either side of the opening of the door. On one end of the axle, a tension bracket connects to one end of the spring. The other end of the spring is attached to a drum wheel that rolls the door. The drum wheel rotates with the axle and the end of the door is attached to the drum wheel. As the axle turns, the door, which is constructed of a sectional material that is flexible enough to roll up, rolls onto the drum wheels.

SUMMARY OF THE INVENTION

The present invention is a spring tensioning mechanism incorporating a frame having a substantially-planar main panel and a bore passing therethrough, and an axle disposed orthogonally to the substantially-planar main panel and passing through the bore. A spring is disposed around the axle. An outboard plate, disposed about the axle, is secured to the frame. The outboard plate incorporates a clocking feature. An inboard plate, having a clocking feature mated to the clocking feature of the outboard plate, is connected to the end of the spring.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
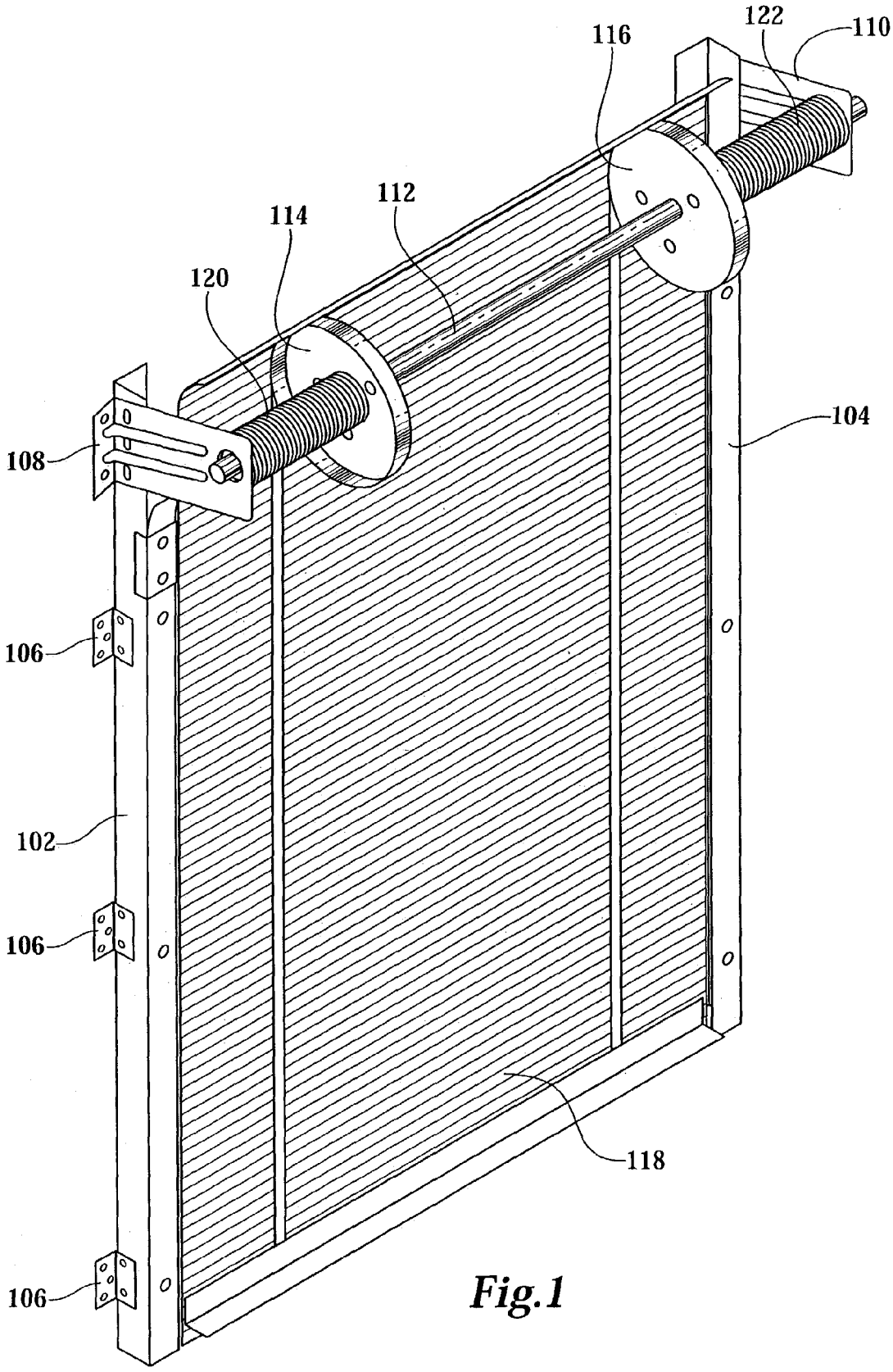
FIG. 1 is an isometric view of an upwardly-acting rolling door.

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the invention.

Door assembly 100 includes a first vertical guide 102 at a first end thereof and a second vertical guide 104 at a second end thereof. Vertical guides 102 and 104 are secured to the door jambs by a set of mounting brackets 106, although other methods of securement may be employed in alternate embodiments. A first support bracket 108 is disposed at the upper end of vertical guide 102. A second support bracket 110 is disposed at the upper end of vertical guide 104. Together, support brackets 108 and 110 support an axle 112 in an orientation generally parallel to both the ground and the principal plane of the door assembly 100.

A first drum 114 is mounted on axle 112 at a first position and a second drum 116 is mounted on axle 112 at a second position. Drums 114 and 116 are secured to the top edge of the door 118 at a point on the perimeter of each. Accordingly, the door 118 will wrap around the perimeter of drums 114 and 116 if the axle 112 is rotated in one direction, and will unwrap from the perimeter of drums 114 and 116 if the axle is rotated in the opposite direction. Because of the effect of gravity on the door 118, the weight of door 118 will tend to draw the door 118 downward and unwrap the door 118 from drums 114 and 116.

In order to counteract the effect of gravity on the door 118, a first coil spring 120 is disposed at a first end of axle 112 and a second coil spring 122 is disposed at a second end of axle 112. As door 118 unwraps from drums 114 and 116, the portion of the door 118 hanging free, and therefore imparting a moment on drums 114 and 116, increases. At the same time, coil springs 120 and 122 wind up as axle 112 rotates, thereby increasing the energy stored in coil springs 120 and 122 and the torque exerted on axle 112 by coil springs 120 and 122. If the torsional spring rate of coil springs 120 and 122 is selected appropriately, the door assembly 100 can be designed so that the torque of coil springs 120 and 122 substantially counteracts the weight of the door 118 at every point through the range of motion of door 118.

Although door assembly 100 is an effective design, it suffers from certain drawbacks. In certain applications it may be desirable to modify a door assembly such as door assembly 100 in order to increase its functionality. The present invention involves a method and apparatus for improving a door assembly such as door assembly 100 while retaining many of the same components of the assembly, thereby minimizing the expense of the upgrade.

As seen in FIGS. 2–6, the components added to the door assembly 100 in order to construct an improved door assembly 200 include outboard plates 210, axle bearings 230 and inboard plates 240. The improved door assembly 200 retains most of the original components of door assembly 100, including support brackets 108 and 110, axle 112 and coil springs 120 and 122.

In order to modify door assembly 100 to incorporate the advantages of door assembly 200, the tension in springs 120 and 122 must first be relieved, in a manner known to those of skill in the art. Once the tension is relieved, axle 112 can be supported in place and one or more of support brackets 108 and 110 can be removed from the ends of axle 112, so as to facilitate addition of upgrade components, as described in more detail below.

Support brackets 108 and 110, which may be retained from the original door assembly 100, have inboard surfaces 202, axle bores 206 and arrays of fastener bores 204. Disposed adjacent to the inboard surface 202 of each support bracket 108 or 110 is the outboard surface 212 of an outboard plate 210. Extending from the inboard surface 214 of the outboard plate 210 is a hollow cylindrical protrusion 220 having an outer surface 222 and an inner surface 226 defining an axle bore 224. Protrusion 220 is surrounded by a set of fastener bores 216, one or more of which has a position aligned to one or more of the fastener bores 204 in the support bracket 108 or 110, so as to facilitate securement of the outboard plate 210 to the support bracket 108 or 110. Outboard plate 210 may also incorporate one or more pin bores 218 sized and shaped to receive a retaining pin 228.

Disposed within the hollow cylindrical protrusion 220 of each outboard plate 210 is a bearing 230 having an outer surface 232 and an inner surface 234. The outer surface 232 is shaped and sized to mate with the inner surface 226 of the axle bore 224, while the inner surface 234 is shaped and sized to mate with the outer surface 236 of the axle 112. Axle 112 rides in the bearings 230 within the outboard plates 210, thereby facilitating smooth, low-friction operation of door assembly 200.

Figure 2:
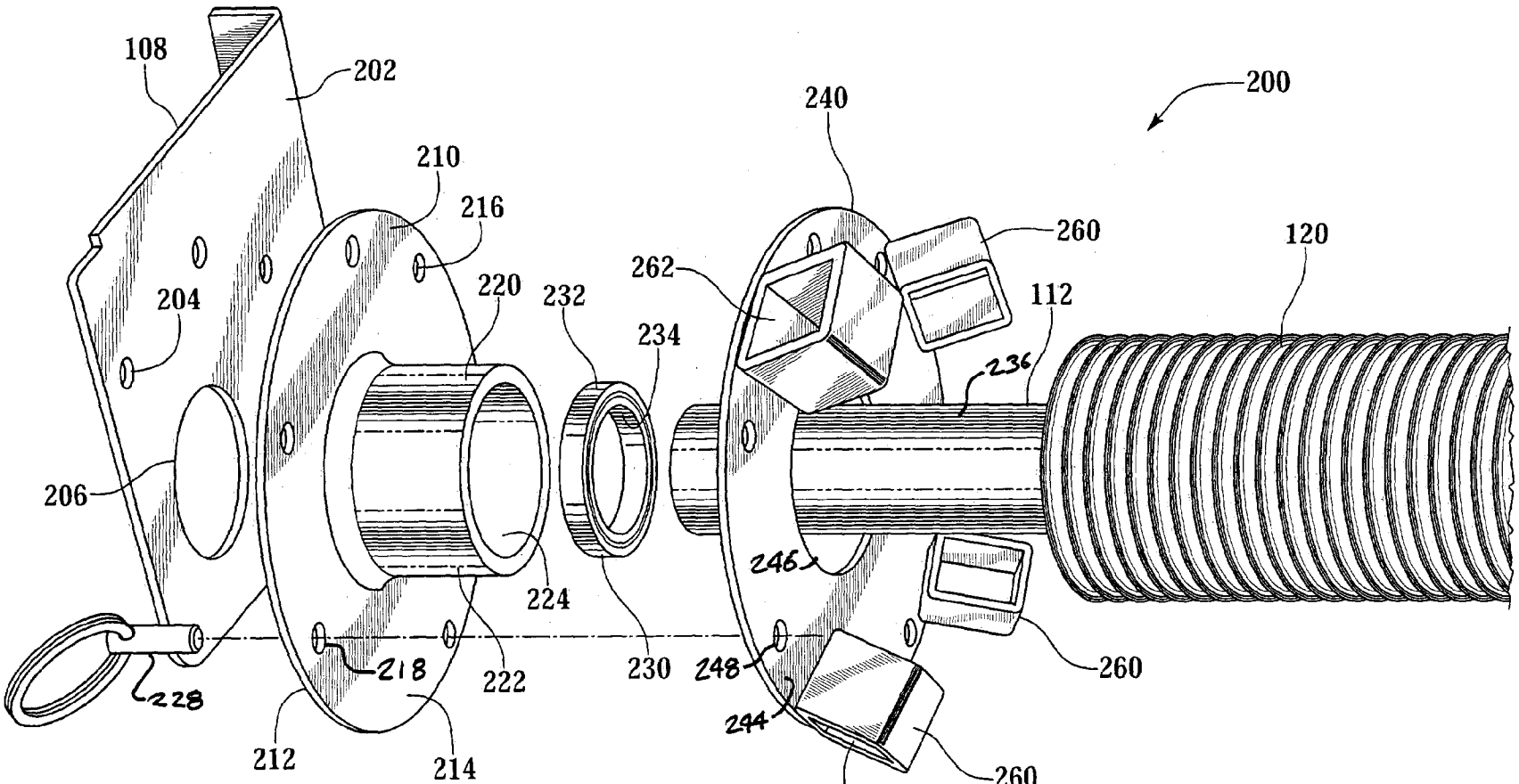
FIG. 2 is an exploded isometric view of a spring tensioning mechanism in accordance with certain embodiments of the present invention.
Figure 4:
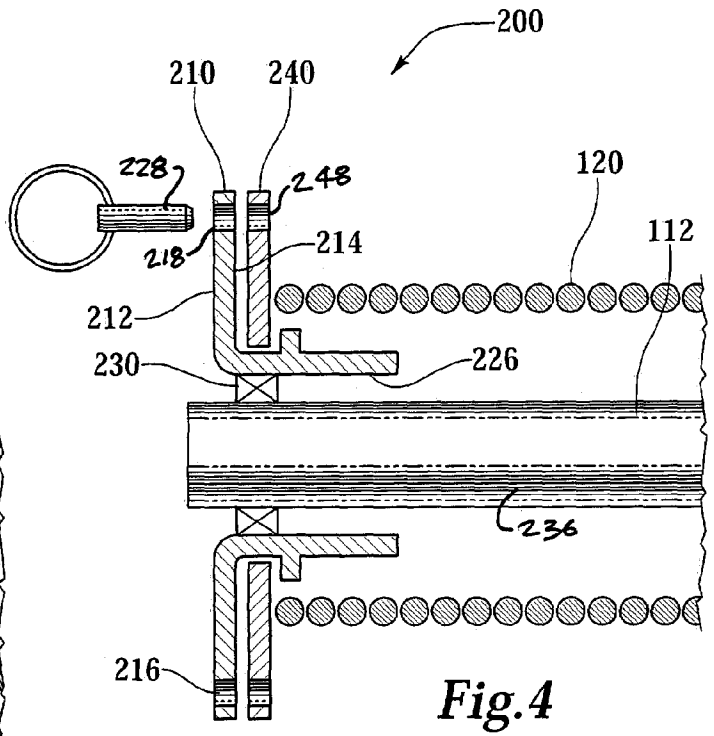
FIG. 4 is a section view of the spring tensioning mechanism depicted in FIG. 3.
Figure 3:
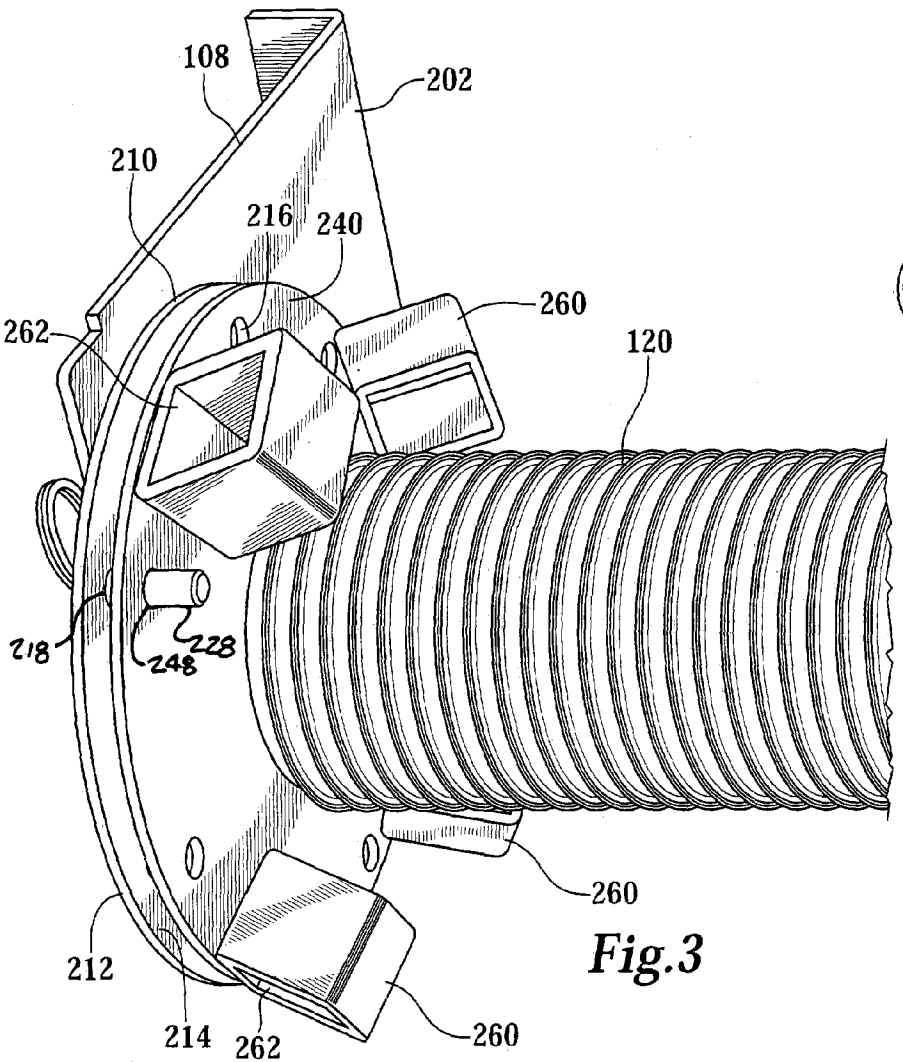
FIG. 3 is an isometric view of the spring tensioning mechanism depicted in FIG. 2.
Figure 5:
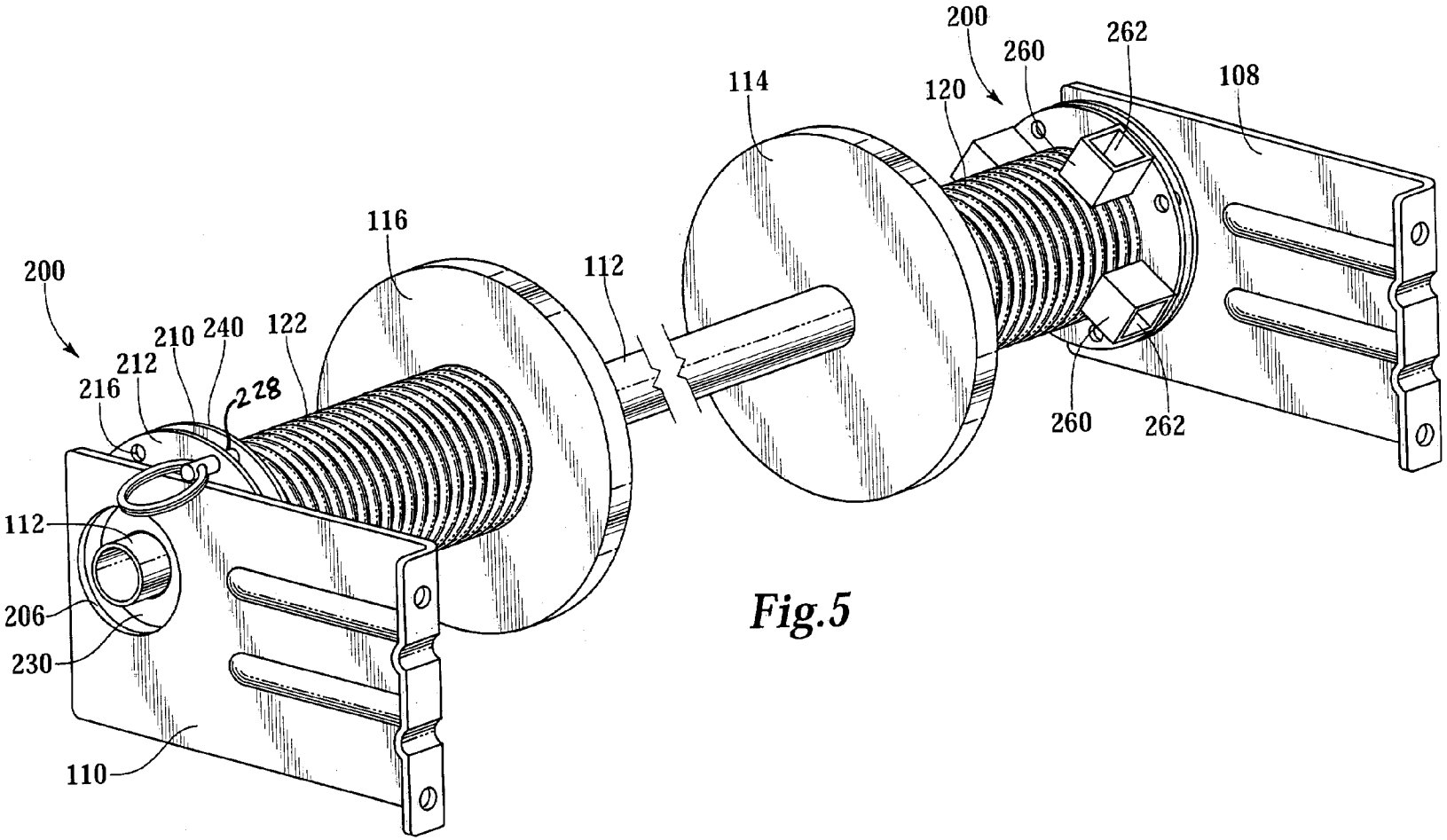
FIG. 5 is an isometric view of an opening mechanism for a rolling door having a tensioning mechanism installed at one end thereof.
Figure 6:
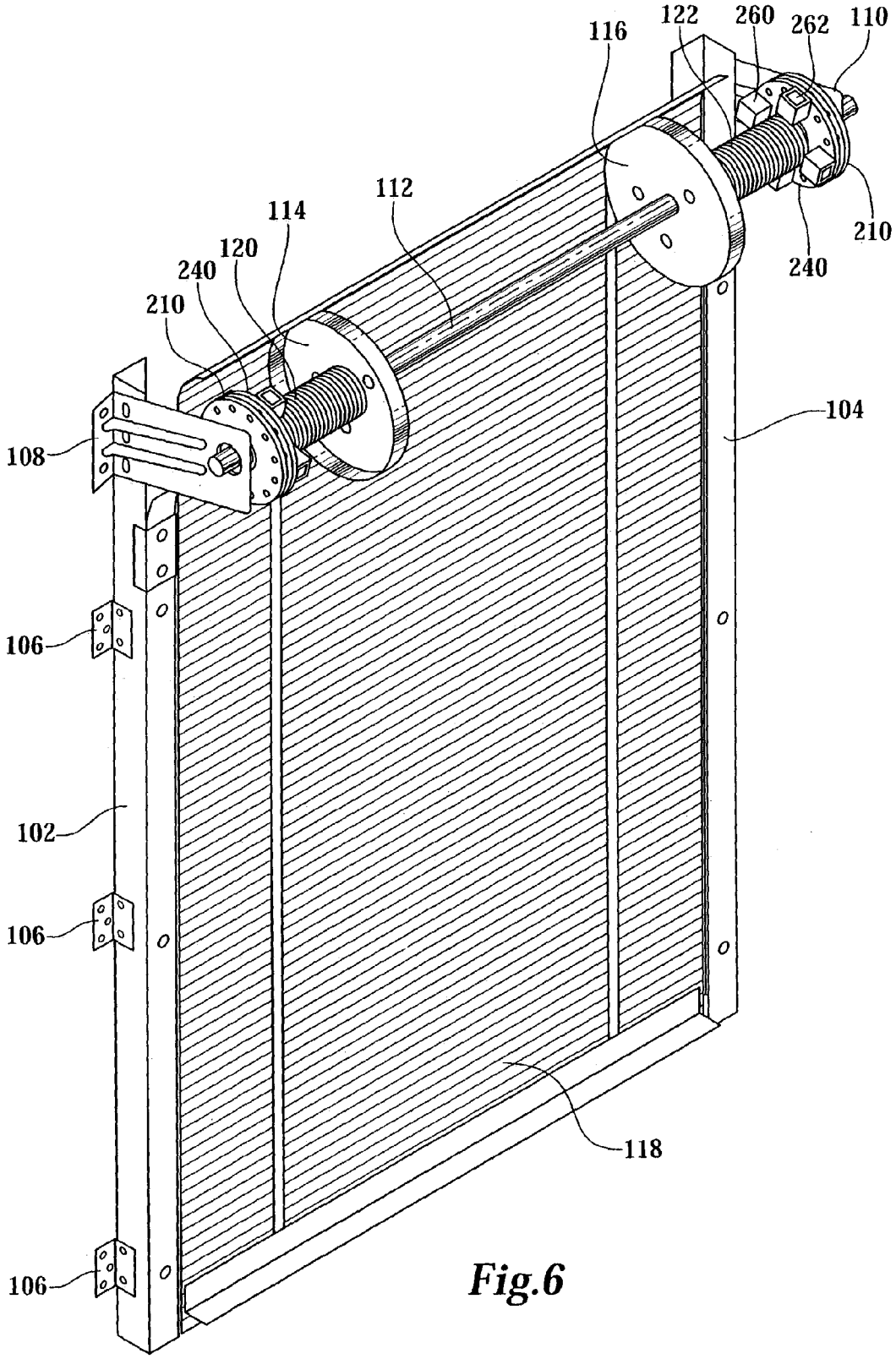
FIG. 6 is an isometric view of an upwardly-acting rolling door having tensioning mechanisms installed at both ends thereof.

Disposed adjacent to the inboard surface 214 of each outboard plate 210 is the outboard surface 242 of an inboard plate 240, which is not fastened to either of outboard plate 210 or support bracket 108. Each inboard plate 240 includes an inboard surface 244, an axle bore 246, and one or more pin bores 248 positioned to align to at least one pin bore 218 in the outboard plate 210 and shaped and sized to receive retaining pin 228. Each inboard plate 240 further includes a set of receivers 260 disposed about the axle bore 246, each having an aperture 262 therein shaped and sized to receive a tensioning lever (not shown). As assembled, each inboard plate 240 is secured to the outboard end of a coil spring 120 or 122. Although only one end of the improved door assembly 200 is shown in FIGS. 2–4, those of skill in the art will appreciate that the opposite end of door assembly 200 is the mirror image of the end shown in FIGS. 2–4. The full door assembly 200 is shown in FIGS. 5 and 6.

Once the improved door assembly 200 is fully assembled, the tension in coil springs 120 and 122 can be adjusted by disposing tensioning levers in the receivers 260 of the inboard plates 240 and unloading the retaining pins 228 so that they can be removed. Once the retaining pins 228 are removed from the improved door assembly 200, the inboard plates 240 are free to rotate with respect to the outboard plates 210. The tension in coil springs 120 and 122 can be increased by rotating the inboard plates 240 in one direction, or decreased by rotating the inboard plates 240 in the opposite direction.

Once the proper tension is imparted to coil springs 120 and 122, respective pin bores 218 and 248 in the outboard plates 210 and inboard plates 240 are aligned and the retaining pins 228 are re-inserted therein, thereby fixing the angular position of the inboard plates 240 with respect to the outboard plates 210.

Although preferred embodiments of the invention have been described in detail, it will be understood by those skilled in the art that various modifications can be made therein without departing from the spirit and scope of the invention as set forth in the appended claims.

What is claimed is:

1. A spring tensioning mechanism comprising:

a support bracket;

an axle, supported by the support bracket;

an outboard plate, disposed adjacent to, and secured to, the support bracket;

an inboard plate, disposed adjacent to the outboard plate and rotatable relative to the outboard plate;

a spring, disposed around the axle, having a first end secured to the inboard plate and a second end operably connected to the axle.

2. The spring tensioning mechanism of claim 1 wherein the outboard plate includes circumferentially spaced bores formed therein.

3. The spring tensioning mechanism of claim 2 wherein circumferential spaced bores on the outboard plate are operable to receive a fastener or a pin.

4. The spring tensioning mechanism of claim 1 wherein the inboard plate includes circumferentially spaced bores formed therein.

5. The spring tensioning mechanism of claim 4 wherein circumferentially spaced bores on the inboard plate are operable to receive a fastener or a pin.

6. The spring tensioning mechanism of claim 2 wherein the bore in the outboard plate cooperates with the bore in the inboard plate.

7. The spring tensioning mechanism of claim 1 wherein the inboard plate comprises at least one receiver.

8. The spring tensioning mechanism of claim 7 wherein the receiver has the shape of a hollow square tube.

9. The spring tensioning mechanism of claim 1 wherein the inboard plate and the outboard plate include a means for securing the inboard plate to the outboard plate in a selected rotational position of the inboard plate with respect to the outboard plate.

10. The spring tensioning mechanism of claim 1 wherein the means for securing include a pin or fastener projecting through cooperating bores formed in the inboard plate and the outboard plate.

11. The spring tensioning mechanism of claim 1 further comprising a bearing supported by the outboard plate for receiving the axle in supportive relationship thereto.

12. A spring tensioning mechanism comprising:

a support bracket having a substantially-planar main panel having an axle bore disposed therein;

an axle, disposed orthogonally to the substantially-planar main panel and passing through the axle bore and having a drum secured thereto;

an outboard plate disposed inboard of the support bracket and secured to the support bracket;

an inboard plate disposed inboard of the outboard plate and rotatable relative to the outboard plate;

a spring, disposed around the shaft, having a first end secured to the inboard plate and a second end secured to the drum.

13. The spring tensioning mechanism of claim 12 wherein the outboard plate includes circumferentially spaced bores formed therein.

14. The spring tensioning mechanism of claim 13 wherein circumferentially spaced bores on the outboard plate are operable to receive a fastener or a pin.

15. The spring tensioning mechanism of claim 12 wherein the inboard plate includes circumferentially spaced bores formed therein.

16. The spring tensioning mechanism of claim 15 wherein circumferentially spaced bores on the inboard plate are operable to receive a fastener or a pin.

17. The spring tensioning mechanism of claim 12 wherein the bore in the outboard plate cooperates with the bore in the inboard plate.

18. The spring tensioning mechanism of claim 12 wherein the inboard plate comprises at least one receiver.

19. The spring tensioning mechanism of claim 18 wherein the receiver has the shape of a hollow square tube.

20. The spring tensioning mechanism of claim 12 wherein the inboard plate and the outboard plate include a means for securing the inboard plate to the outboard plate in a selected rotational position of the inboard plate with respect to the outboard plate.

21. The spring tensioning mechanism of claim 12 wherein the means for securing include a pin or fastener projecting through cooperating bores formed in the inboard plate and the outboard plate.

22. The spring tensioning mechanism of claim 12 further comprising a bearing supported by the outboard plate for receiving the axle in supportive relationship thereto.

23. A spring tensioning mechanism comprising:

a support bracket having a substantially-planar main panel having an axle bore therein, and a mounting panel disposed orthogonally to the main panel;

an outboard plate having a bearing therein the outboard plate being disposed inboard of the support bracket and secured thereto by at least one fastener;

an axle, supported by the bearing and having a drum disposed thereon, disposed orthogonally to the substantially-planar main panel and passing through the axle bore;

an inboard plate disposed inboard of and rotatable relative to the outboard plate and having a set of receivers disposed adjacent to the perimeter thereof; and a coil spring, disposed around the shaft, having a first end secured to the inboard plate and a second end secured to the drum.

24. The spring tensioning mechanism of claim 23 the outboard plate and the inboard plate include a means for securing the inboard plate to the outboard plate in a selected rotational position of the inboard plate with respect to the outboard plate.

25. The spring tensioning mechanism of claim 23 wherein the means for securing include a pin or fastener projecting through cooperating bores formed in the inboard plate and the outboard plate.

26. The spring tensioning mechanism of claim 23 further comprising a retaining pin shaped and sized to lock the radial orientation of the inboard plate with respect to the outboard plate.

* * * * *